United States Patent [19]

Prew

[11] 4,093,130

[45] June 6, 1978

[54] TWIN REFINER APPARATUS

[75] Inventor: Stanley Robert Prew, Montoursville, Pa.

[73] Assignee: Koppers Company, Inc., Pittsburgh, Pa.

[21] Appl. No.: 780,827

[22] Filed: Mar. 24, 1977

[51] Int. Cl.[2] ..... B02C 7/14

[52] U.S. Cl. ..... 241/245; 241/259.1

[58] Field of Search ..... 241/244, 245, 248, 259.1, 241/259.2, 297

[56] References Cited

U.S. PATENT DOCUMENTS

| | | | |
|---|---|---|---|
| 2,864,562 | 12/1958 | Eberhardt et al. | 241/245 X |
| 2,930,534 | 3/1960 | Baxter, Jr. | 241/259.1 X |
| 3,118,622 | 1/1964 | Jones | 241/245 X |
| 3,276,701 | 10/1966 | Fisher | 241/297 X |
| 3,754,714 | 8/1973 | Reinhall | 241/259.1 X |
| 3,845,910 | 11/1974 | Cledaniel | 241/245 |

FOREIGN PATENT DOCUMENTS

| | | | |
|---|---|---|---|
| 316,802 | 3/1971 | U.S.S.R. | 241/245 |

*Primary Examiner*—Howard N. Goldberg
*Attorney, Agent, or Firm*—Herbert J. Zeh, Jr.; Oscar B. Brumback

[57] ABSTRACT

An improved pressurized disc refiner having a pair of oppositely facing non rotating refiner plates and a rotating disc having refiner plates on each face thereof juxtaposed the non rotating refiner plates. The rotating refiner plates and at least one of the non rotating refiner plates are axially adjustable to compensate for wear and to insure that an equal and opposite thrust force is produced on opposite sides of the rotating refiner plates. During the plate changing operation, both of the non rotating refiner plates are independently movable axially along the drive shaft away from the rotating disc for simultaneous access to both of the non rotating refiner plates and both of the rotating refiner plates to facilitate changing of the refiner plates. The refiner has a split mechanical stop to limit movement of the axially adjustable non rotating refiner plates axially away from the rotating refiner plate during the refining operation of the apparatus. The refiner also has one or two horizontal inlets located on the side of the refiner.

3 Claims, 5 Drawing Figures

TWIN REFINER APPARATUS

BACKGROUND OF THE INVENTION

The present invention relates generally to disc type refiners, particularly pressurized disc type refiners having a rotating disc with refiner surfaces on both sides thereof juxtaposed between a pair of non rotating refiner plates.

Twin disc type refiners are well known, particularly in the paper making field and essentially comprise juxtaposed annular refining surfaces which are arranged for relative rotation so that material to be refined is introduced at the inner edge of the surfaces and is transported between the surfaces and peripherally discharged in a refined condition. The twin refiners typically include a central rotating disc having attrition plates on each side thereof cooperating with oppositely disposed rotationally fixed attrition plates. One or both of the non rotating plates are supported on heads that are axially adjustable to vary the plate spacing and the shaft carrying the rotating head may be either axially adjustable or free floating.

Many commercial units are based on the above general operation. For example, commercial twin refiners are manufactured by the following companies: Beliot Jones; Black Clawson; Balton Emerson; Morden; and Koppers-Sprout Waldron (assignee of the subject application). All of the units heretofore manufactured by the above companies have found acceptance in the industry but still have one or more drawbacks. For example, during the normal operation of the refiner the attrition plates wear out and must be periodically replaced. The periodic replacement of refiner plates usually takes about 5 to 6 hours because of the difficulty in getting access to all the refiner plates. In all of the prior art twin refiner units, it is necessary to move the rotating center disc or to actually remove the rotating center disc to gain access to all the refiner plates. It is also necessary in some of the prior art refiners to disrupt the normal shaft sealing surfaces from each other during the plate changing operation. Also, all of the prior units have inlets at or near the top of the unit which enter the unit at a vertical angle. This location of the inlet or inlets almost requires the use of overhead piping.

According to the present invention, an improved twin refiner is provided for overcoming the foregoing described drawbacks of the prior art refiners. The twin refiner of the present invention provides for the independent axial movement of both of the non rotating refiner plates away from the rotating refiner plates for easy access to all of the refiner plates. The improved refiner allows access to all of the refiner plates at the same time and without any necessity of moving the rotating center disc and without the necessity of disrupting the normal shaft sealing surfaces.

The improved disc type refiner of the present invention includes a base with an integral housing supported by the base, a drive shaft extending through the housing, means on the housing for rotatably supporting the drive shaft, a pair of non rotating plate holders mounted within the housing in spaced opposed relation, a rotating disc mounted on the drive shaft between the non rotating plate holders, refiner plates disposed on each side of the rotating disc in parallel juxtaposed relation to refiner plates disposed on the adjacent non rotating plate holders, means connecting the drive shaft and rotating disc to provide rotation of the disc with the shaft, means for permitting axial movement of the shaft and rotating disc, means for permitting axial adjustment of one of the non-rotating plate holder, inlet means for conveying material to be refined into the housing between the juxtaposed refining plates, means for removing the refined material from the housing, means for adjusting the axial position of at least one of the non rotating plate holders, and means for moving both non rotating plate holders with plates axially away from the rotating disc for easy access to all the refiner plates.

The rotating disc refiner of the present invention also provides for one or two horizontal inlets on the side along the center line of the refiner. In this position the inlets give the refiner user the flexibility of running the piping either overhead or under the floor.

The improved refiner of the present invention also has a mechanical stop means for limiting the axially adjustable non rotating refiner plates from disengaging the peripheral seal between the plate holder and refining cavity during operation. The volume of material passing through the refiner may have a flow rate of from 200 gal/min to over 7,000 gal/min and any disengagement of the peripheral seal would have serious adverse effects.

Many patents have issued on twin refiners. For example, see Fisher, U.S. Pat. No. 3,276,701; Fisher, et al., U.S. Pat. No. 3,893,631; Fisher, U.S. Pat. No. 3,701,488 and Jones et al., U.S. Pat. Nos. 2,690,098 and 2,727,440. All of the above patents have been considered but do not show the improved aspects of the present invention. The present invention is particularly concerned with an improvement of the type of twin refiner disclosed in Fisher, U.S. Pat. No. 3,276,701 and the disclosure in that patent is hereby incorporated by reference.

Other objects and advantages of this invention will become more apparent from the following description, the accompanying drawings and the appended claims.

IN THE DRAWINGS

Figure 1:
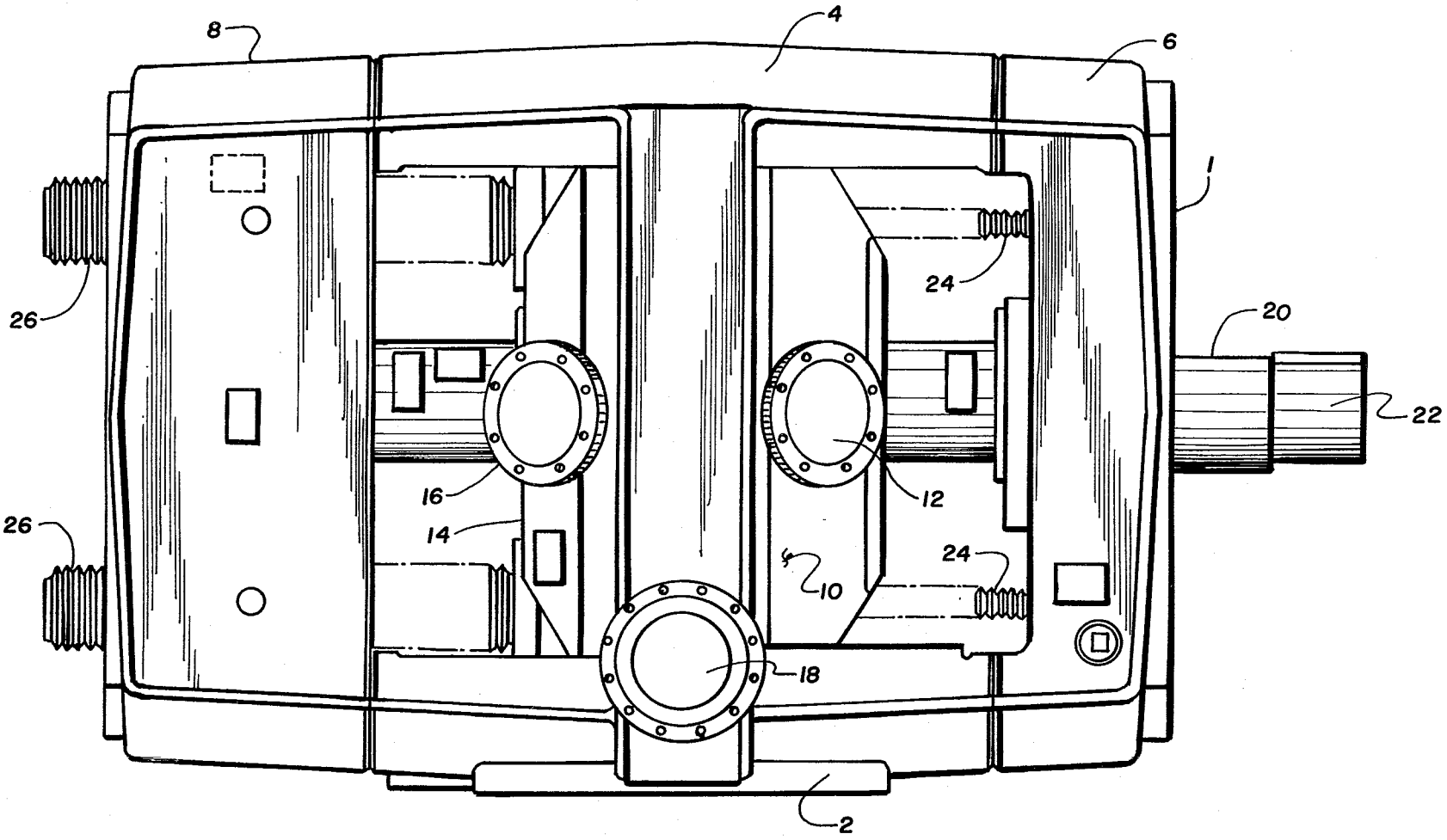
FIG. 1 is a side elevation of the refiner apparatus of the present invention.
Figure 2:
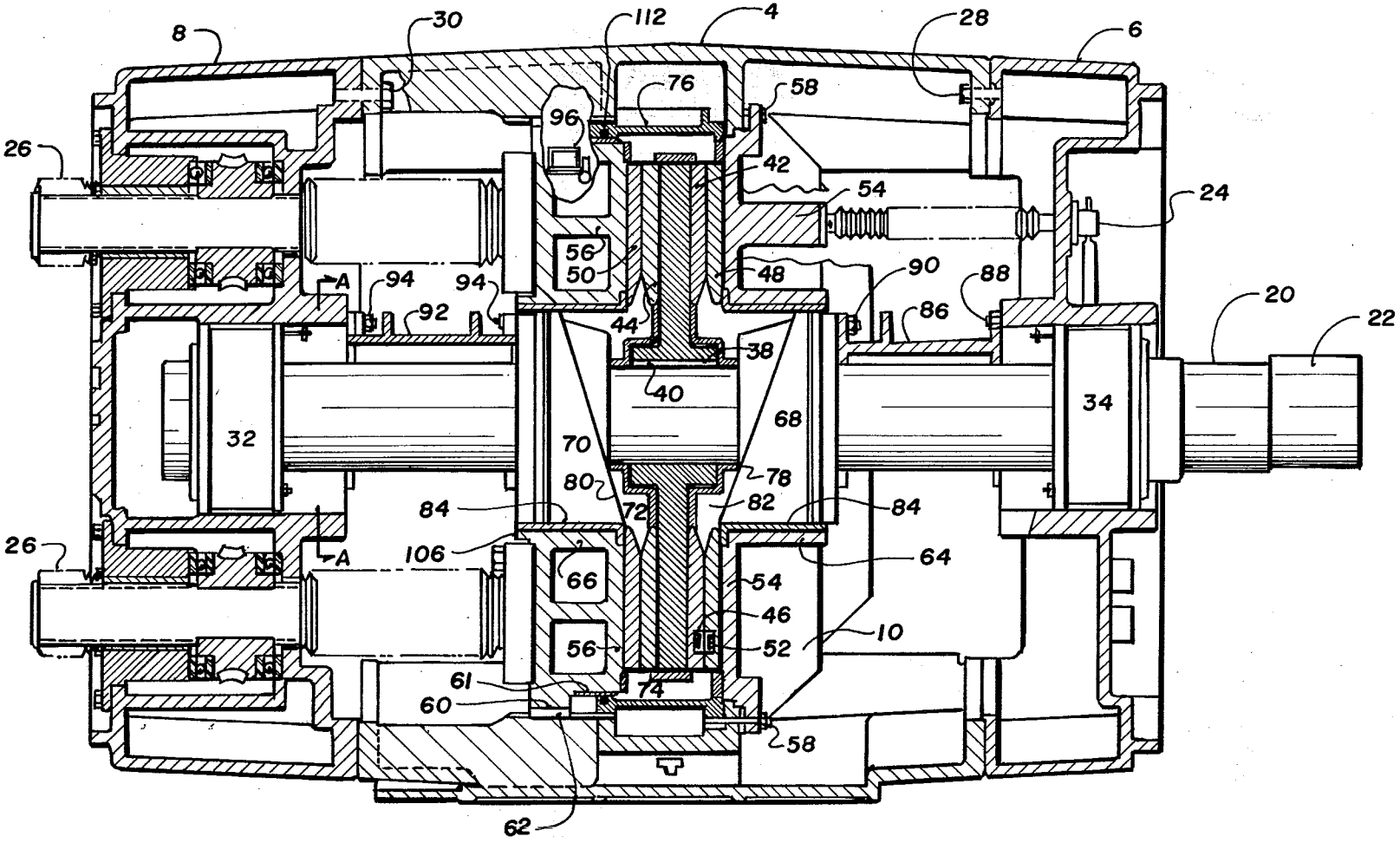
FIG. 2 is a vertical axial section through the refiner of FIG. 1.
Figure 3:
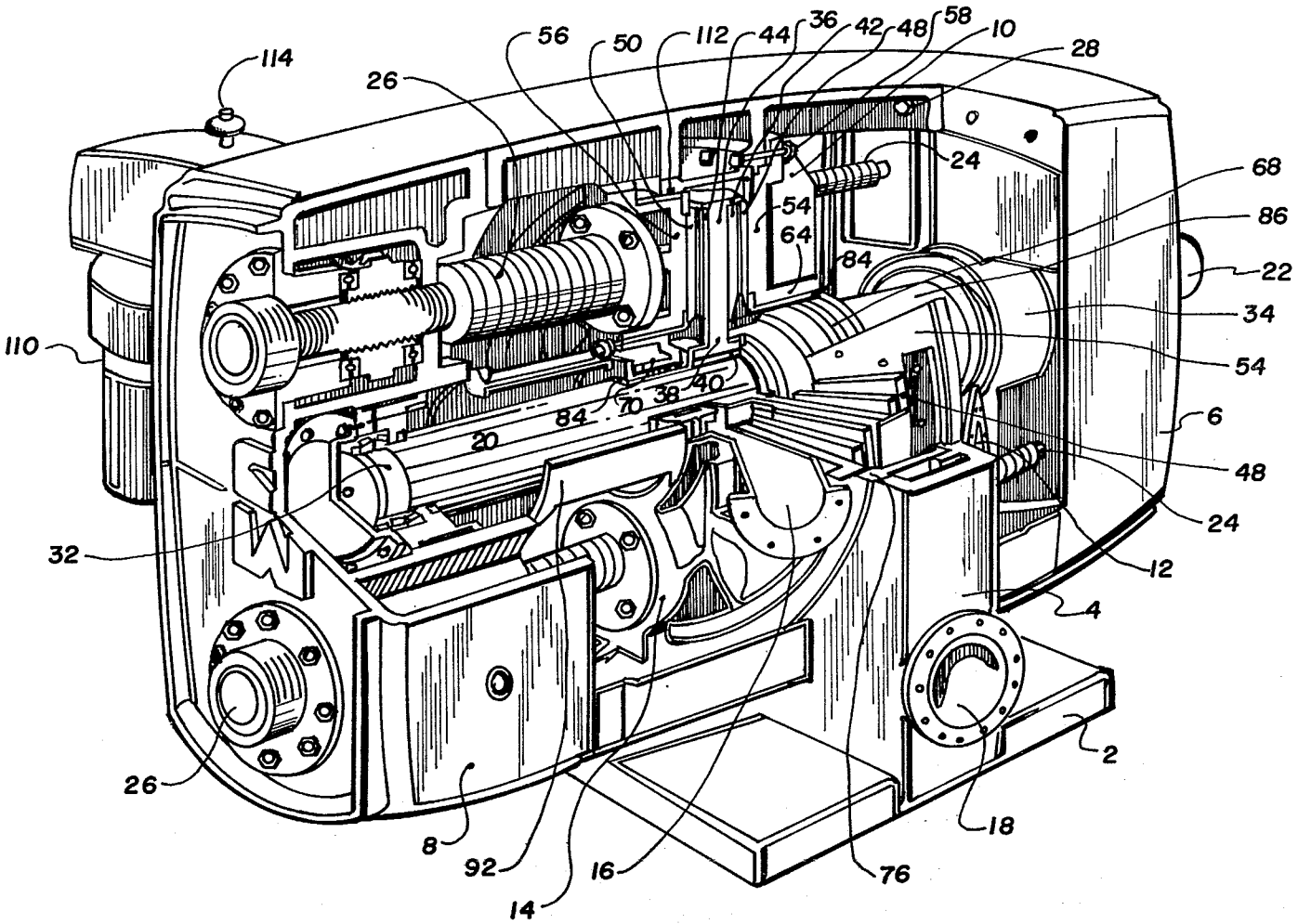
FIG. 3 is a perspective view of the refiner apparatus of the present invention.

Referring to the drawings in which like reference characters refer to like parts throughout the several views, there is illustrated a refiner of the present invention. With reference to FIG. 1, 2 and 3 there is provided a base 2 for the support of the refiner apparatus 1. Integral with the base is a central housing 4 generally shaped in the form of an I for holding a rotating disc. Mounted on one side of the central housing is a drive end housing 6 generally of channel shape and mounted on the other side of the central housing is a similarly shaped plate adjusting assembly housing 8. Mounted between the drive end housing and the center of the central housing is a non rotating plate assembly comprising a flat circular movable housing 10 having a horizontal inlet 12. Mounted between the plate adjusting assembly housing and the center of the central housing in an adjustable non rotating plate assembly comprising a flat circular movable housing 14 having a horizontal inlet 16. Central housing 4 has a discharge outlet 18 disposed in the bottom portion thereof.

The refiner has a drive shaft 20 with means 22 for mounting a drive coupling to a drive motor, not shown. The drive shaft extends from the drive coupling means through the center of the drive end housing, through the center of the central housing and into the center of the plate adjusting assembly housing. As noted, the refiner has a pair of plate retracting means 24 extending from the drive end housing to movable housing 10 for retracting movable housing and its contents axially away from the center of the central housing. The refiner also has a pair of plate adjusting means 26 extending from the plate adjusting assembly housing into the adjustable movable housing 14. The plate adjusting means 26 adjusts the axial position of one of the non rotating plate holders during refining and also acts as a plate retracting means to retract movable housing 14 and its contents axially away from the center of central housing 4 during plate changing.

As illustrated more particularly in FIGS. 2 and 3 the refiner apparatus includes an I shaped central housing 4. Mounted to one end of the central housing by a plurality of mounting means 28 is drive end housing 6. Mounted to the other end of the central housing by a plurality of mounting means 30 is the plate adjusting assembly housing 8. Drive shaft 20 is coupled to motor means (not shown) by drive coupling means 22. The drive shaft extends from the coupling means 22 through the center of the drive end housing, through the center of the central housing and into the center of the plate adjusting assembly housing. Drive shaft 20 is supported in the plate adjusting assembly housing by bearing assembly 32 and is supported in the drive end housing by bearing assembly 34. Bearing assembly 32 is mounted substantially in the center of the plate adjusting assembly housing and bearing assembly 34 is mounted substantially in the center of the drive end housing.

The refiner includes a rotating disc 36 mounted by hub 38 on shaft 20 and keyed thereto at 40. Rotating disc 36 is located in the center of the central housing and carries a set of annular refining surfaces or refiner plates of known design 42 and 44 fixed to opposite faces of disc 36 as by bolts 46. Mating and cooperating refiner plates 48 and 50 are mounted as by bolts 52 on non rotating heads or plate holders 54 and 56 respectively. Plate holders 54 and 56 are preferably integrally cast as part of movable housing 10 and adjustable movable housing 14 respectively. The non rotating plate holder assembly is axially fixed by a plurality of holding means 58. The non rotating plate holder 54 is integral with movable housing 10 and attached to central housing 4 so as to be non rotating and axially stationary during operation but axially movable away from the rotating disc and plates for easy access for changing plates. The movable housing 10 and its contents are held axially fixed during the refining operation by the plurality of holding means 58.

Non rotating plate holder 56 is similarly mounted within and preferably integral with movable housing 14. A projection 60 on the annular rim 61 of non rotating plate holder 56 allows the non rotating plate holder 56 and plates 50 to move axially with respect to the non rotating plates 48 and rotating disc 36. The projection 60 slides axially along surface 62 of central housing 4.

Each of the non rotating plate holders 54 and 56 carries a generally cylindrical axially extending portion 64 and 66 respectively defining with packing glands 68 and 70 around shaft 20 a pre refining chamber 72 for receiving material to be treated and confining such material away from the various bearing and drive members of the refiner. Radially outwardly of the rotating disc 36 and the various refiner plates 42, 44, 48 and 50 the material being treated is confined in refining chamber 74. Refining chamber 74 is formed by the arcuate face of the rotating disc and refiner plates 42, 44, 48 and 50 and outer rim 76. Outer rim 76 is preferably integrally cast as part of central housing 4. Refining chamber 74 communicates with discharge outlet 18 for removing the refined material from the refiner.

Packing glands 68 and 70 preferably have tapered surfaces 78 and 80 for directing the material to be treated into the area between the various refining plates. Rotating disc 36, hub 38 and parts of shaft 20 are preferably covered with a shroud 82. The material used to make the shroud will depend on the material to be refined. It is also within the scope of this invention to make rotating disc 36 out of corrosion resistant material. A rotating disc of corrosion resistant material is necessary in single inlet units since no shrouds are utilized in a single inlet unit. It should be noted that the packing life is longer in the present refiner compared to prior art refiners since the shaft and associated packing boxes are stationary and not moved during plate changing. The shaft is not moved and hence the packing is not disengaged.

As noted above, rotating disc 36 is mounted on shaft 20 which is supported at either end thereof by bearing structures 32 and 34 located in plate adjusting assembly housing and drive end housing respectively. Detailed description of the bearing structures are omitted herein since they are well known in the prior art. For example, see U.S. Pat. Nos. 3,893,631, 3,701,488 and particularly 3,276,701 which describe in detail bearing assembly structures 32 and 34 that are useful in the present refiner. The patents describe bearing assembly structures which provide for the axially movement of rotating disc 36 to compensate for wear and to insure that equal and opposite thrust forces are produced on opposite sides of the rotating refiner plates.

As mentioned supra, non rotating plates 48 and plate holder 54 are axially fixed during operation but are axially movable away from the rotating disc for changing the refiner plates. A pair of plate and plate holder retracting means 24 are provided for moving the plates 48 and plate holders 54 away from the non rotating disc for easy access to rotating plates 42 and non rotating plates 48. The retracting means are generally screw jacks that are attached to the non rotating plate holder assembly. The retracting means is generally attached to movable housing 10 and extends through the open space between the central housing and the drive end housing, and through the drive end housing. The retracting means may be activated by manual means or by a mechanical means. The cylindrical axial portion of non rotating plate holder 54 is preferably covered with a wear surface 84 for easy movement of the plate holder along the radial surface of the packing gland 68 during axial movement of the plates. Packing gland 68 is maintained in position both during the refining operation and during the plate changing operation by packing gland spacer 86. Packing gland spacer is attached to the drive end housing by a plurality of bolt means 88 and to packing gland 68 by a plurality of bolt means 90.

Also as mentioned supra, non rotating plates 50 and plate holders 56 are axially adjustable relative to non rotating plate holder 54 with plates 48 and rotating disc 36 with rotating plates 42. The axially adjustable non rotating plate holder 54 and plates 50 are also retractable axially away from center disc 36 for easy access to plates 44 and 50. There is provided a pair of plate adjusting means 26 for continuously adjusting the axial position of non rotating plates 50 during the refining operations. The plate adjusting means are driven by a motor 110 shown in FIG. 3 and are responsive to an external signal that is related to the motor load, flow rate, temperature, pressure or some other parameter of the refining process. The plate adjusting means may be hydraulic or electromechanical. The use of hydraulic means would generally comprise several hydraulic cylinders to provide the required forces to positively control the spacing. The electromechanical means generally comprises a pair of worm gear jacks connected to a motor. FIGS. 1, 2 and 3 illustrate an embodiment using worm gear jacks. Suitable plate adjusting means are also described in U.S. Pat. Nos. 3,276,701, 3,893,631 and 3,701,488, particularly 3,276,701.

The plate adjusting means 26 also act as the plate retracting means for the axially adjustable non rotating plate holder and plates. Generally the plate adjusting motor is too slow for use as a plate retracting means. By disengaging the plate adjusting means with disengaging means 114 from the source of external control and activating it with a less sensitive manual or mechanical means it can be used to axially retract plates 50 and plate holder 56. The cylindrical axial portion of adjustable non rotating plate holder 56 is also preferably covered with a wear surface 84 for easy movement of the plate holder along the radial surface of packing gland 70 during plate changing.

Packing gland 70 is maintained in position both during the refining operation and during the plate changing operation by packing gland spacer 92. Packing gland spacer 92 is better called a mechanical stop since it also limits the axially movement of plate holder 56 and plates 50 during the refining operation. Mechanical stop 92 is attached to packing gland 70 by bolt means 94 and to the plate adjusting assembly housing by a plurality of similar bolt means 94. The plate adjusting means 26 also has associated therewith a limit switch 96. Whenever the refiner is in operation, limit switch 96 senses the location of plate holder 56 and plates 50 and when activated de-energizes the gear motor thus limiting the axial movement of the adjustable non rotating plate holder assembly. The mechanical stop 92 provides a fail safe backup for the limit switch.

Figure 5:
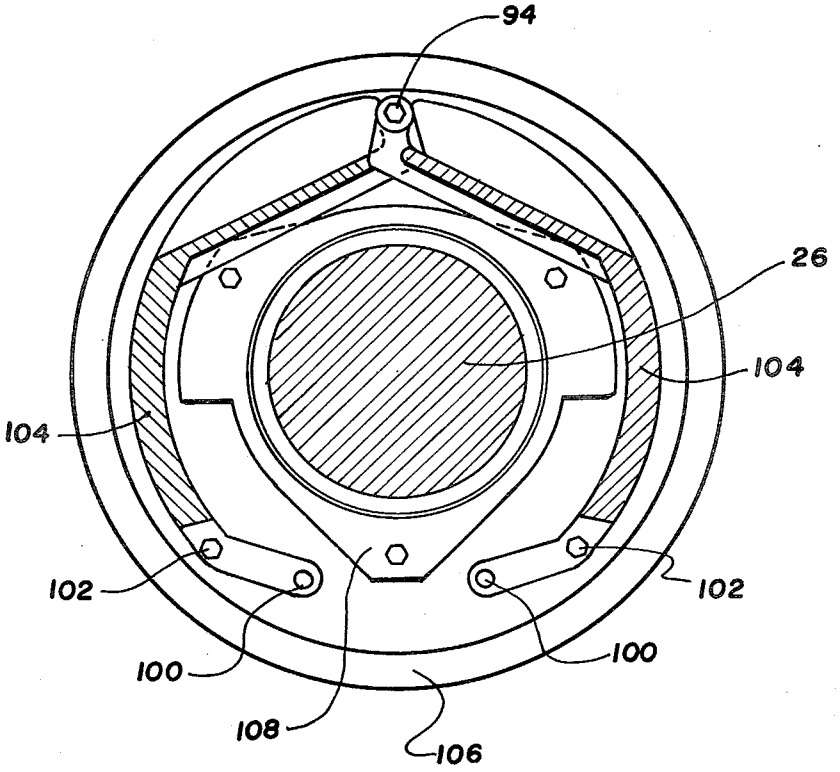
FIG. 5 is a view along line AA of FIG. 2 showing the mechanical stop means during the plate changing operation.
Figure 4:
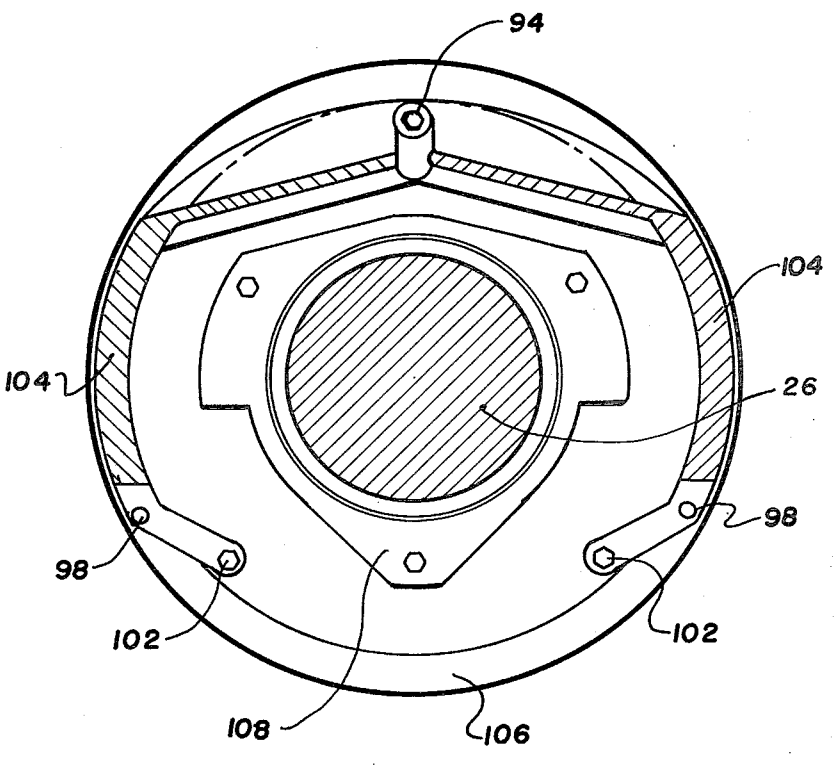
FIG. 4 is a view along line AA of FIG. 2 showing the mechanical stop means during the refining operation.

With reference to FIG. 4 and FIG. 5 which are views along lines AA of FIG. 2 there is illustrated the mechanical stop means of the present invention. The mechanical stop means has the shape of a caliper and is essentially a disengaging caliper stop. With respect to FIG. 4 the caliper stop is shown in the stop position which is during the refining operation. The caliper is pivotally mounted at the top by bolt means 94 also shown in FIG. 2. Each arcuate arm of the disengaging caliper stop has a pair of holes at the end thereof shown at 98 and 100. During engagement the arcuate arms of the caliper stop are held in a fixed position by bolt means 102 passing through hole 100 and attached to the packing gland 70 and adjustable plate assembly housing 8 (as shown in FIG. 2). During engagement, the arcuate caliper arms 104 are in overlapping relationship with the surface 106 which is the end of wear surface 84 and cylindrical axial portion 66 thus preventing the adjustable non rotating plate holder from moving axially away from the rotating disc and disengaging the peripheral seal 112 between adjustable plate holder 56 and the refiner cavity. If the limit switch should fail, the axial movement of the adjustable plates would be stopped when the plate holder comes in contact with the mechanical stop. The motor driving the axial movement of the adjustable plate holder has a shear pin assembly to disengage the motor should the use of the mechanical stop be necessary. FIGS. 4 and 5 also shows a packing follower 108 on the end of the packing gland 70 and around shaft 20.

When it is necessary to retract the axially adjustable non rotating plate holder 56 and plates 50 for changing, the mechanical stop means is moved to the plate changing position, FIG. 5. Disengagement of the caliper stop is done by removing bolt means 102 from hole 100, pivoting the arms of the caliper stop inward until they no longer are in overlapping relationship with surface 106 and the holes 98 are in the original position of holes 100. Bolt means 102 are then passed through holes 98 to hold the arms in the disengaging position. This allows the bore of the axially adjustable plate holder to be retracted over the mechanical stop for access to the refining surfaces 44 and 50.

As will be understood from the foregoing, the present invention provides a refiner having easy access to all attrition surfaces. When it becomes necessary to change the plates, both of the non rotating plate holders and plates are axially movable away from the rotating center disc and plates for simultaneous access to all attrition surfaces. Plate changing becomes an easier operation with less down time of the refiner.

For changing plates bolt means 58 holding non rotating plates holder 54 with plates 48 and movable housing 10 in position against central housing 4 are removed. Plate retracting means 24 is then activated and plate holder 54 with plates 48 moves axially away from rotating disc 36 with rotating plates 42. The plate holder 54 with plates 48 and movable housing 10 are moved axially away until the movable housing comes in contact with or is in near contact with the drive end housing. With the refiner in this position, easy access is had for changing plates 42 and 48. At the same time, easy access may be had to plates 44 and 50 by first deactivating the plate adjusting means 26 from its automatic plate adjusting operation. Then mechanical stop 92 is disengaged as described above. With the caliper stop disengaged, plate adjusting means 26 is activated as a plate retracting means. Plate holder 56 with plates 50 and movable housing 14 are moved axially away until the movable housing 14 comes in contact with or is in near contact with the plate adjusting assembly housing. With the refiner in this position, easy access is had for changing plates 44 and 50. From the above it can be seen that the present refiner gives simultaneous access to all the wear surfaces for easy changing without the necessity of moving the shaft and rotating disc. Refiner plates 42, 44, 48 and 50 may be easily changed without having to move the rotating disc. After the plates are changed, the above procedure is reversed and the refiner is in position for the refining process.

FIGS. 2 and 3 describe a refiner of the present invention having dual inlets 12 and 16. Inlet 12 extends through movable housing 10 at the horizontal center line of the refiner into central chamber 72. The tapered surface 78 of packing gland 68 directs the material into the pre-refiner chamber 72 and into the space between the attrition plates. Inlet 16 extends through movable housing 14 at the horizontal center line of the refiner into central chamber 72. The tapered surface 80 of packing gland 70 directs the material to be refined into pre-refiner chamber 72 and into the space between the attrition plates. The horizontal inlets into the side of the refiner are an improvement over the prior art inlets which were vertical inlets into the top of the refiner. The horizontal side inlets provide the flexibility of running the piping overhead or under the floor.

It is also within the scope of this invention to use a single horizontal inlet and have the stream of influent material be split internally. Whenever only one inlet is used, it is preferred that the inlet be located on the drive end side of the refiner, that is, through movable housing 10. In this case, tapered surface 80 of packing gland 70 is replaced with a vertical surface that is flush with wear surface 66. Also, when only one inlet is used the center disc must have holes provided therein for passage of the material to both sides of the rotating attrition surfaces.

It should also be noted that if desired the apparatus of the present invention may be non pressurized and the material to be treated fed thereto by a conveying means and discharged therefrom by gravity. In this configuration, both non rotating plate holders are axially adjustable and the packing assemblies are not required.

In keeping within the scope of this invention, it may be desirable to provide a series of openings through rotating disc 36. Such openings communicate between opposite sides of the rotating discs. The use of the openings is necessary in models that have a single inlet for subsequent split of the feed inside the refiner. In such applications, part of the feed coming into one side of the refiner passes through the openings in the rotating disc to reach the other set of refining surfaces.

I claim:

1. A disc type refiner comprising a base with an integral central housing, a first channel shaped housing attached to one end of the central housing, a second channel shaped housing attached to the other end of the central housing, a drive shaft extending through the first channel shaped housing, the central housing and into the second channel shaped housing, means in the first and second channel shaped housing for rotatably supporting the drive shaft, a non rotating plate holder mounted within a first movable housing located between the central housing and the first channel shaped housing, a second non rotating plate holder mounted within a second movable housing located between the central housing and the second channel shaped housing, the pair of non rotating plate holders being in spaced opposed relation and having refiner plates disposed on each opposed face of the non rotating plate holders, a rotating disc mounted on the drive shaft between the non rotating refiner plates, refiner plates disposed on each side of the rotating disc in parallel juxtaposed relation to the refiner plates disposed on the opposed non rotating plate holders, means connecting the drive shaft and rotating disc to provide rotation of the disc with the shaft, means for axially adjusting the spacing between the rotating refiner plates and non rotating refiner plates during refining to insure that equal and opposite thrusts are produced on opposite sides of the rotating refiner plates, inlet means for conveying material to be refined into the central housing and directing the material between the juxtaposed refining plates, outlet means for removing the refined material from the central housing, means for changing all refiner plates without moving the rotating center disc, the changing means comprising means for axially retracting the first movable housing with non rotating plate holder and plates away from the rotating center disc and means for axially retracting the second movable housing with non rotating plate holder and plates away fron the rotating center disc.

2. A disc type refiner as in claim 1, further including a mechanical stop means for limiting the axial movement of at least one of the movable housings with non rotating plate holder and plates axially away from the rotating disc during refining, the mechanical stop means being movable to allow axial movement of such movable housing with non rotating plate holder and plates away from the rotating disc during plate changing.

3. An improved disc type refiner of the type including a base, an integral housing supported by the base, a drive shaft extending through the housing, means in the housing for rotatably supporting the drive shaft, a pair of non rotating plate holders mounted within the housing in spaced opposed relation, a rotating disc mounted on the drive shaft between the non rotating plate holders, refiner plates disposed on each side of the rotating disc in parallel juxtaposed relation to refiner plates disposed on the adjacent non rotating plate holders, means connecting the drive shaft and rotating disc to provide rotation of the disc with the shaft, means for axially adjusting the spacing between the rotating and non rotating refiner plates during refining to insure that equal and opposite thrust forces are produced on opposite sides of the rotating refiner plates, inlet means for conveying material to be refined into the housing between the juxtaposed refining plates, means for removing the refined material from the housing, wherein the improvement comprises means for changing all refiner plates without moving the rotating center disc, the changing means comprising means for moving both non rotating plate holders with plates axially away from the rotating disc, the improvement further including a mechanical stop means for preventing the axial movement of at least one of the non rotating plate holders with plates axially away from the rotating disc during refining, the mechanical stop means being movable to allow axial movement of such non rotating plate holder with plates sufficiently away from the rotating disc to allow access to all refiner plates during plate changing.

* * * * *